US007532846B2

(12) United States Patent
Schmidt et al.

(10) Patent No.: US 7,532,846 B2
(45) Date of Patent: May 12, 2009

(54) TREATING TRANSPORT MECHANISM IN A PRINTING PRESS

(75) Inventors: Soenke Schmidt, Kiel (DE); Detlef Schulze-Hagenest, Molfsee (DE); Udo Draeger, Speyer (DE)

(73) Assignee: Eastman Kodak Company, Rochester, NY (US)

( * ) Notice: Subject to any disclaimer, the term of this patent is extended or adjusted under 35 U.S.C. 154(b) by 237 days.

(21) Appl. No.: 10/570,060

(22) PCT Filed: Aug. 30, 2004

(86) PCT No.: PCT/US2004/028168

§ 371 (c)(1),
(2), (4) Date: Sep. 11, 2006

(87) PCT Pub. No.: WO2005/026847

PCT Pub. Date: Mar. 24, 2005

(65) Prior Publication Data

US 2007/0041743 A1 Feb. 22, 2007

(30) Foreign Application Priority Data

Sep. 4, 2003 (DE) ..... 103 40 706

(51) Int. Cl.
*G03G 15/20* (2006.01)
*G03G 15/00* (2006.01)
*G03G 15/16* (2006.01)

(52) U.S. Cl. ..... 399/312; 399/71; 399/101

(58) Field of Classification Search ..... 399/91, 399/98, 101, 297, 301, 302, 308, 312
See application file for complete search history.

(56) References Cited

U.S. PATENT DOCUMENTS 5,506,669 A 4/1996 Inoue et al.
5,854,962 A 12/1998 Boockholdt et al.
2002/0044798 A1 * 4/2002 Katsumi et al. ..... 399/297

FOREIGN PATENT DOCUMENTS

JP 56055976 5/1981

* cited by examiner

*Primary Examiner*—Hoang Ngo
(74) *Attorney, Agent, or Firm*—Lawrence P. Kessler

(57) ABSTRACT

Treating a transport mechanism (5) for transporting print material (2) in a printing press (1) that uses toner in which oil-bearing substances (27) adhere to the transport mechanism (5). A cleaning device (30) is provided with at least one cleaning element (33) movable relative to the surface of the transport mechanism (5) for application of at least one oil-repelling substance (37) that reduces the adherence of the oil-bearing substances (27) to the transport mechanism (5). Accordingly, this cleaning element (33) can strip the surface of the transport mechanism (5) of oil-bearing substances (27).

10 Claims, 2 Drawing Sheets

TREATING TRANSPORT MECHANISM IN A PRINTING PRESS

FIELD OF THE INVENTION

The present invention relates to treating a transport mechanism for transporting print material in a printing press that uses toner in which oil-bearing substances, specifically silicone oil, can enter the transport mechanism.

BACKGROUND OF THE INVENTION

In printing processes such as electrophotographic printing, many toner images are produced in many printing units or repetitively, in one printing unit in order to produce a print image on a print material. In general, these toner images contain the colors cyan (C), magenta (M), yellow (Y), and black (K). To produce these toner images, first a latent electrostatic image is formed on an imaging medium. The imaging medium can be an imaging cylinder or a corresponding imaging band that, in each case, has a photoconductive surface layer.

The imaging cylinder is exposed, for example, by a row or a field of laser diodes or LEDS, a latent image is produced in this manner. Due to the light, previously charged regions of the surface of the imaging cylinder are discharged. The imaging cylinder then passes a development unit where toner is transferred via an inking unit to the surface of the imaging cylinder, and is held there through electrostatic forces. Dry toner or liquid toner can be used that in each case, has charged particles.

A voltage is applied to the area between the surfaces of the development unit and the imaging cylinder. Depending on the various potentials of the surfaces and on the function of the charge of the toner particles used, they remain adherent to the unexposed areas (charged area development, CAD) or to the exposed areas (discharged area development, DAD) of the imaging cylinder. Here, particularly, the charge sign of the toner particles are significant. For further discussion, see, for example, "Electrophotography and Development Physics", in the second revised edition by L. B. Schein, 1996 that appeared as a reprint from Laplacian Press, pp. 32 ff.

The toner can be transferred directly from the imaging cylinder to print material with the aid of electrostatic forces. It is also common to use an additional transfer medium. Thus, the toner is transferred first from the imaging cylinder to the transfer medium, and can then be transferred from the transfer medium to the print material. The transfer medium can be, for example, a rubber blanket cylinder or a transfer belt.

When using transfer belts specifically, another possibility arises namely, that the toner images of the individual printing units are first transferred atop one another on the transfer belt and are then transferred in one step, from the transfer belt to the print material.

After the various toner images are applied on a print material atop one another, they are fused in a fusing apparatus onto the print material. This can be accomplished through the influence of pressure and heat on the print material. The print material is transported for this purpose, with a transport mechanism, such as a conveyor belt or transport rollers with grippers through the printing press. A fusing apparatus for example, has a fusing roller and a counter-pressure cylinder. Both the fusing roller and the counter-pressure cylinder can be heated. The print material can then be transported with the toner through the nip that is formed by the fusing roller and the counter-pressure cylinder. The toner is then fused on the print material through heat and pressure.

One problem that can arise in using such a fusing procedure is known as an "offset" of the toner. In this case, toner can adhere to the fusing roller and possibly to the counter-pressure cylinder and thus, soil these components. In order to prevent an offset, silicone oil and/or other oil-bearing substances are applied as a separating medium to the surface of the fusing roller and perhaps to the counter-pressure cylinder. However, the usage of such oil-bearing substances has also proven to be problematic.

In a duplex printing process, a print material is printed on both sides. There are various alternative methods of executing this process. For each side of the print material, independent printing units can be used. Then, with the same printing process used to print the first side, the second side is also printed and the toner images on both print material sides can be simultaneously fused on the print material.

In an alternative process, the first print material side is printed. The print material is then rotated in a rotating device before the second side is printing in the same printing units. Only after this second passing of the print material passes through the printing units of the printing press, this second time, is the print material fed through a fusing apparatus. The toner images on both sides of the print material are then fused simultaneously fused by the fusing apparatus on the print material.

One problem with this alternative process is that the unfused toner images abut onto the transport mechanism during the second passing of the print material through the printing units. The toner images may endure smearing before they are definitively fused.

In a third preferred duplex printing process, the first print image produced by the printing units on the first print material side, is fused before the second side of the print material is printed. To achieve this purpose, a second independent printing press can be used, or, preferably, the print material can be rotated, by a rotating device, and the second side can be printed with the same printing units previously used to print the first side. The print image produced in this manner on the second print material side, is then finally fused by the same fusing apparatus on the print material, as was the print image on the first print material side.

Particularly, in multicolor printing presses, it is not desirable, in terms of cost and space, to install a second set of identical printing units within the printing press. Thus, the first duplex printing process presented is frequently rejected. In order to avoid the smearing of toner on the print material that can occur in a second run through the printing press, the third duplex printing process is frequently used.

As described above, to avoid an offset of toner within the fusing apparatus, oil-bearing substances, particularly silicone oil, are used as a separating medium. This separating medium should, if possible, form a closed layer on the surface of the fusing roller, or alternatively on the counter-pressure cylinder. In other words, sufficient separating medium must be applied. Since the separating medium comes into contact with the surface of the print material during the fusing procedure oil-bearing substances adhering to the surface of the fused print material cannot be avoided.

These oil-bearing substances are found on the side of the print material that abuts, onto the transport mechanism in a duplex printing process, during the second pass through the printing units. Accordingly, the oil-bearing substances can also get onto the surface of this transport mechanism and therethrough into the individual printing units.

These oil-bearing substances can unfavorably disrupt the transfer of toner between the individual areas: within an inking unit, from the development unit, or alternatively the inking unit onto the imaging cylinder, or from the imaging cylinder onto a transfer medium such as a rubber blanket cylinder, and finally, onto the paper. This impairment of the toner transfer can lead to smearing or streaking formations on the print image. The varying toner density can also negatively affect a print material.

More silicone oil is applied on the fusing roller at the beginning of a printing process than at a later time point. If a uniform layer of silicone oil is formed on the fusing roller initially, less oil needs to be applied onto the fusing roller. Thus, the toner transfer at the beginning of a printing press is more intensive, but not as impaired as at a later point in time. Accordingly, one must either accept greater quality fluctuations within a printing process or endure more waste paper.

If oil-bearing substances adhere to the imaging cylinder, it can disrupt the electrophotographic process, and lead to uncontrollable variances in the print image produced.

SUMMARY OF THE INVENTION

Thus, the object of the present invention is to provide for treating a transport mechanism, where the impairment of the toner transfer and/or the electrophotographic process as a result of oil-bearing substances, particularly, silicone oil, can at least, be decreased. This invention should not be limited here to the duplex printing process. It should constantly be applicable whenever oil-bearing substances, particularly silicone oil, can adhere to a transport mechanism in a printing press.

The objective of the invention is achieved through the application of at least one oil-repelling substance that reduces the adherence of the oil-bearing substances to the transport mechanism. In a beneficial manner, through at least one oil-repelling substance, the ability of the transport mechanism to accept the oil-bearing substances is at a minimum decreased.

In a beneficial provision of the method, it is provided that the surface of the treated transport mechanism is then stripped of the oil-bearing substances. To achieve this cleaning, a cleaning device is provided as a solution with the apparatus having at least one cleaning element that is movable, relative to a surface of the transport mechanism. This cleaning element can then clean the surface of the transport mechanism. This cleaning element can be, for example, a roller, a cylinder, a belt, or a movable, gripped cloth.

At least one application element is provided for applying at least one oil-repelling substance onto the transport mechanism, in a beneficial provision of the apparatus. Such an application element can be, for example, an application roller. This roller can be supplied with the oil-repelling substance either from the inside or from the outside, and can then applied, this substance onto the transport mechanism directly, or indirectly through use of additional elements, such as sponges or cloths.

Since the oil-bearing substances exhibit at least a decreased adherence to the surface of the transport mechanism, it is now possible to simply completely remove them from the surface and to clean the latter so that impairment of the toner transfer and of the electrophotographic process is at least, decreased. Ideally, the oil-bearing substances will be present in the form of drops on the surface.

In a favorable embodiment, the at least single oil-repelling substance acts as surface that is to be stripped of the oil-bearing substances. Here, the oil-repelling substance is then sufficient to beneficially clean this surface.

Since, in this case, the oil-bearing substances are favorably present in the form of drops on the surface, a simple method of cleaning is possible in the manner that does not impair the surface formed.

In an alternate embodiment, provision can be made regarding the cleaning for the single oil-repelling substance to be simultaneously removed from the surface, at least partially. Accordingly, a particularly simple method for cleaning can be used. No consideration needs to be made regarding the coating. In both alternate embodiments, the cleaning can occur according to the invention, via a cloth that is at least slightly infused, preferably, with surfactants.

Specifically, in the method where the oil-repelling substance acts as the surface to be cleaned, this cloth then need only be lightly guided over the surface for cleaning to occur in order for it to remove the oil-bearing substances. This simple process is plausible primarily because the oil-bearing substances tend to form drops as a result of the decreased adherence. The drops can simply be removed with a cleaning, using a cloth, according to the invention. According to the invention, a cleaning device can include the cloth as the cleaning element for this type of cleaning.

In the case where the oil-repelling substances are simultaneously removed from the transport mechanism, beneficially, no additional attention needs to be paid to the contact pressure of the cloth. The pressure needs to be sufficient enough to simultaneously remove the oil-bearing substances in addition to the oil-repelling substance.

In a further beneficial development, it is provided that during the cleaning process, the at least single oil-repelling substance is freshly applied. This can occur specifically, through an application element according to the invention. Moreover, provision can be made so that after a removal of the at least single oil-repelling substance, the oil-repelling substance is reapplied then, after oil-bearing substances have again adhered to the surface of the transport mechanism again, the oil-repelling substance is removed again.

According to the invention, provision should be beneficially made for the cleaning device to include also the application element for applying the at least single oil-repelling substance. In a specific embodiment, this element can be the cloth according to the invention. The cloth should be infused to achieve this purpose of removing the oil-repelling substance, and it can be beneficially moved in the direction counter to the rotation of the transport mechanism. The cloth then runs off on the surface of the transport mechanism so that first the oil-bearing substance, simultaneously with the oil-repelling substance, is removed, and simultaneously a new oil-repelling substance is applied onto the cleaned surface.

In a beneficial embodiment, the oil-repelling substance is surfactants. Its behavior is well known. The oil-bearing substances will form drops on the surfactants and subsequently, the surfactants can be simply removed along with the oil drops from the surface of the transport mechanism. A cloth that is impregnated with surfactants can then reapply surfactants onto the surface.

In an alternate embodiment, provision is to be made for the oil-repelling substances to include at least one A/B block polymer made of two different polymers, a first polymer A being hydrophobic, and a second polymer B being hydrophilic. These block polymers settle on the surface of the transport mechanism so that the hydrophobic polymer A lies on the surface of the transport mechanism, while the hydrophilic polymer B lies thereover forming a new surface. According to the invention, the block polymer forms a new surface to be cleaned. In the cleaning process, only the oil-bearing substances that form drops on the hydrophilic layer of the A/B block polymer are removed.

The invention, and its objects and advantages, will become more apparent in the detailed description of the preferred embodiment presented below.

BRIEF DESCRIPTION OF THE DRAWINGS

An exemplary embodiment of an apparatus for treating a transport mechanism (but to which the invention is not limited in its scope) is shown in the drawings. The figures are as follows.

DETAILED DESCRIPTION OF THE INVENTION

Figure 1:
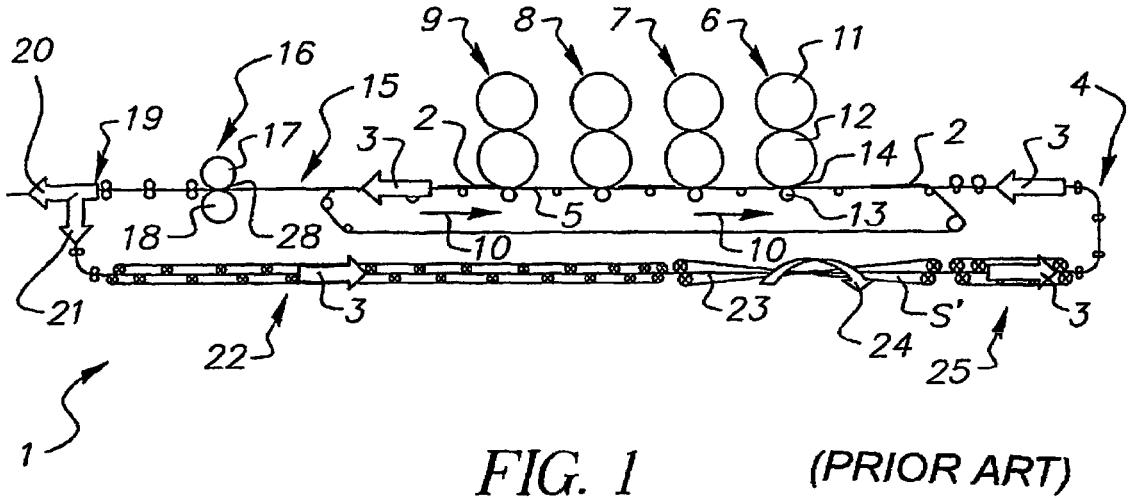
FIG. 1 (PRIOR ART)
FIG. 1 is a portion of a printing press according to prior art with a rotating device.

Referring now to the accompanying drawings, FIG. 1 shows a portion of a printing press 1, according to prior art. This printing press 1 is a printing press that uses toner, e.g. a NexPress 2100®. A print material, in this case, a sheet of paper 2, is transported along a transport path that is illustrated using arrows 3. The sheet 2 is transported from an initial section 4 of the transport path on a conveyor belt 5. This conveyor belt 5 then conveys the sheet 2 further through printing units 6 through 9. The conveyor belt 5 is guided in the direction of arrows 10 to achieve this purpose.

The printing units 6 through 9 respectively have an imaging cylinder 11 that transfers a toner layer that is produced on it onto a blanket cylinder 12. The representation of an imaging device for the imaging cylinder 11 and of inking units for applying the toner layer was intentionally omitted for further information, refer to the large body of prior art in this area. The sheet 2 is fed through a nip 14 between the blanket cylinder 12 and a printing cylinder 13. The toner layer is transferred onto the sheet 2. In each printing unit 6 through 9, another toner image is transferred onto the sheet 2 in this manner. The toner images exhibit, for example, the colors cyan (C), magenta (M), yellow (Y), and black (K).

After the last printing unit 9, the sheet 2 leaves the conveyor belt 5 and reaches a further section 15 of the transport path. The sheet 2 is then guided through a fusing device 16. There, the toner is fused onto the sheet 2 through the use of pressure and heat. To achieve this purpose, the fusing device 16 has a fusing roller 17 and a counter-pressure cylinder 18, with at least the fusing roller 17 being heated.

Subsequent to the fusing process, the sheet 2 reaches a path switch 19. Sheets 2 that are only to be printed on one side, or that are already printed on both sides are transported in the direction of the arrow 20. Sheets 2 that will be printed on both sides are guided in the direction of the arrow 21 into a further section 22 of the transport path. In the section 22 of the transport path, the sheets 2 are transported through a rotating device 23 where they are rotated so that their second side is printed when next passed through the printing units 6 through 9. The rotating of the sheet 2 is represented by an arrow 24. A final section 25 of the transport path subsequently guides the sheet 2 back to the initial section 4. The second side of the sheet 2 is now facing up. The sheet 2 is again brought onto the conveyor belt 5, with the previously printed side of the sheet 2 abutting the surface of the conveyor belt.

During the second passage of sheet 2 through the printing units 6 through 9, toner images are additionally superimposed on the sheet 2 and are then fused on the sheet 2 in the fusing device 16. In the path switch 19, the sheet 2 that has had both sides printed, is conveyed along in the direction of the arrow 20, and is fed to an extension not further depicted here.

Figure 2:
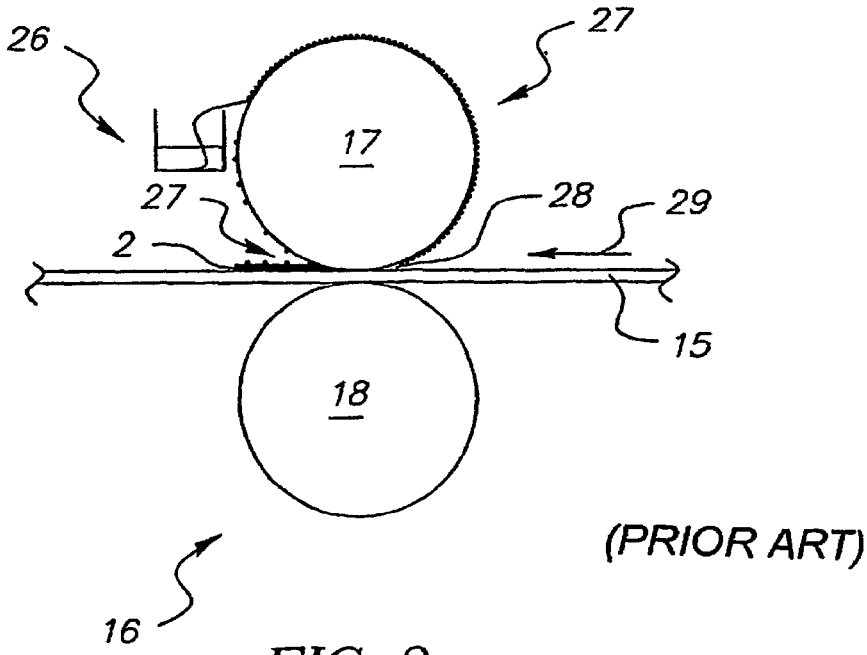
(PRIOR ART) FIG. 2
FIG. 2 is a fusing device with silicone oil as a separating medium.

In FIG. 2, a fusing device 16, according to FIG. 1, is shown. A sheet 2 is transported on the section 15 of the transport path through the fusing device 16 in the direction of the arrow 29. The fusing roller 17 is heated. The fusing roller 17 is situated opposite a counter-pressure cylinder 18. They are pressed against each other to form a nip 28 through which the sheet 2 is transported. Under the simultaneous influence of the heat and the pressure, a toner (not shown) is fused on the sheet 2 in the nip 28.

To prevent an offset of the toner from occurring in the fusing roller 17, the fusing roller 17 is applied with silicone oil 27 through an oil application device 26. The silicone oil 27 applied to the fusing roller 17 prevents the adherence of the toner on the fusing roller 17. In the area of the nip 28, the sheet 2 comes into contact with the surface of the fusing roller 17; here, silicone oil 27 partially adheres to at least the upper side of the sheet 2 that was applied with toner.

Figure 3:
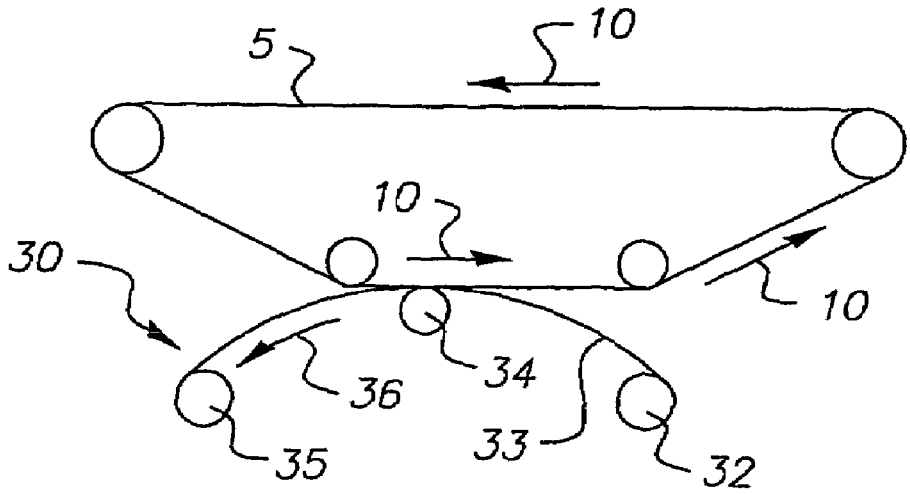
FIG. 3 is a conveyor belt and an apparatus for its maintenance.

As explained, the silicone oil 27 can leak from the first side of the sheet 2, during passage through the nip 28, onto the surface of the conveyor belt 5 and finally, from the surface of conveyor belt 5, during a second pass through the printing units 6 through 9. FIG. 3 shows a conveyor belt 5 and a cleaning device 30 for treating the abovementioned leak. The cleaning device 30 cleans the conveyor belt 5 in a manner so that silicone oil 27 is at least removed from the surface preventing its further penetration into the printing units 6 through 9, which disrupts the toner transfer or the imaging of the imaging cylinder 11.

To achieve this purpose, the cleaning device 30 includes a supply roller 32 that contains a porous cloth 33. The cloth 33 is connected via a soft application roller 34 to a take-up roller 35. The cloth 33 is unwound from the supply roller 32 and wound up by the take-up roller 35, so that it is moved in a direction of the arrow 36 counters to the direction 10 of the conveyor belt 5. The cloth 33 is then pressed by the soft application roller 34 onto the surface of the conveyor belt 5. The application roller 34 releases surfactants 37 onto the cloth 33, which subsequently transfers them onto the surface of the conveyor belt 5 as a result of its porous structure. The surfactants 37 on the surface of the conveyor belt 5 are more precisely depicted in FIG. 4.

In the direction 36 of the movement of the cloth 33, after the transfer of the surfactants 37, the conveyor belt is cleaned with the cloth 33 removing the surfactants 37 and silicone oil 27 found thereon. Since the cloth 33 moves in a direction counter to the direction 10 of the movement of the conveyor belt 5, the belt 5 is first cleaned of surfactants 37 and silicone oil 27 before surfactants 37 are reapplied atop the conveyor belt 5. The cloth 33 used in this manner is finally wound up by the take-up roller 35. It can then be, exchanged, cleaned, and reused, for example.

Once freshly applied with surfactants 37, the conveyor belt 5 is further moved in direction 10 in order to transport the sheets 2 that are to be printed through the printing units 6 through 9. There, silicone oil 27 can again adhere to the surface of the conveyor belt 5. This silicone oil 27 is again removed, along with the surfactants 37, from the surface of the conveyor belt 5.

Figure 4:
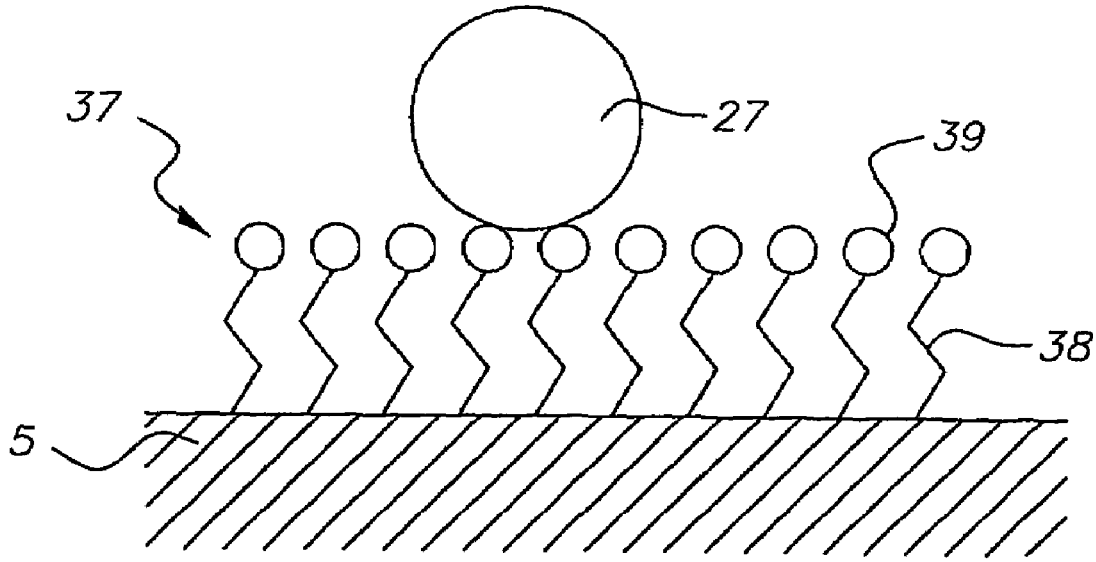
FIG. 4 is an enlarged lateral representation of a conveyor belt with surfactants applied as an oil-repelling substance.

FIG. 4 depicts an enlarged lateral representation of a conveyor belt 5 with surfactants 37 applied as an oil-repelling substance.

The surfactants 37 applied with the application roller 34 and the porous cloth 33 on the conveyor belt 5, have both a lipophilic component 38 and a lipophobic component 39. The lipophilic component 38 concentrates on the surface of the conveyor belt 5, so that the lipophobic components 39 are positioned away from the conveyor belt 5. Accordingly, the lipophobic components 39 form an area on the conveyor belt 5 on which the silicone oil 27 is deposited without significantly moistening the surface of the conveyor belt 5.

The silicone oil 27 forms a drop formation on the surface of the lipophobic components 39. Accordingly, the silicone oil 27 can simply be removed along with the underlying layer of surfactants 37. The removal occurs through the use of the cleaning device 30, as already explained in further detail in conjunction with FIG. 3.

It is possible for the oil-repelling layer not to be simultaneously removed from the surface of the conveyor belt 5, with the cleaning device 30 or a similar apparatus. Thus, it can be possible, in particular, for the force of the contact pressure of the cloth 33 on the conveyor belt 5 to be weaker than the force used for an intentional removal of the oil-repelling layer.

It is further possible for the surface of the conveyor belt 5 to be pre-treated with oil-repelling substances, e.g., hydrophobic/hydrophilic A/B block polymers. These substances can be applied onto the conveyor belt 5 outside of the printing press 1, or, a second apparatus (not depicted) can be provided that has an application unit that coats an uncoated conveyor belt 5 with oil-repelling substances.

The effect of these oil-repelling substances, particularly, the A/B block polymers, is equivalent to the effect of the surfactants 37. In particular, the B polymers form a lipophobic surface to be cleaned on the conveyor belt 5. There, the silicone oil 27 forms drops that can easily be removed using a cleaning device 30. In this case as well, a perforated cloth 33 should be used that is lightly infused with surfactants 37 using the application roller 34. The contact pressure force of the cloth 33 should then be weak enough to prevent further impairment of the surface made of A/B block polymers, but strong enough to continue to remove the silicone oil 27.

Naturally, it is also possible for the cloth 33 to be pre-infused with surfactants 37 on the supply roller 32. Consequently, the application roller 34 is no longer necessary; an elastic contact pressure roller is sufficient. This apparatus essentially corresponds to the apparatus shown in FIG. 3, with the inclusion of a contact pressure roller instead of the application roller 34.

In the manner described, using the inventive cleaning device 30 for each passage of the conveyor belt 5, a surface that is free of silicone oils 27 or other oil-bearing substances is guaranteed. Thus, no silicone oil 27 can adhere to one of the printing units 6 through 9 via the conveyor belt 5. The toner transfer and the exposure of the imaging cylinders 11 will not be impaired by silicone oil 27, the quality of the produced print image will be improved, and the waste paper will be reduced.

What is claimed is:

1. A method for treating a transport mechanism for transporting a print material in a printing press that uses toner where oil-bearing substances, such as, silicone oil, can adhere to said transport mechanism, characterized by applying at least one oil-repelling substance that reduces said adherence of said oil-bearing substances to said transport mechanism.

2. The method according to claim 1, characterized by said surface of said treated transport mechanism being cleaned by being stripped of said oil-bearing substances.

3. The method according to claim 2, characterized by said at least one oil-repelling substance acting as a surface that is to be stripped of said oil-bearing substances.

4. The method according to claim 2, characterized by said during said cleaning at least a single oil-repelling substance is simultaneously pre-removed from said surface.

5. The method according to claim 2, characterized by said cleaning of said surface occurs with a cloth (33) that is infused at least slightly, with surfactants (37).

6. The method according to claim 4, characterized by during said cleaning, said at least a single oil-repelling substance is freshly reapplied.

7. The method according to claim 1, characterized in that said oil-repelling substances has at least one A/B block polymer made of at least two different polymers, a first polymer A being hydrophobic and a second polymer B that is hydrophilic.

8. The method according to claim 6, characterized by said at least single oil-repelling substance has surfactants (37).

9. An apparatus for treating a transport mechanism for transporting print material in a printing press that uses toner with oil-bearing substances, such as silicone oil, that adhere to said transport mechanism, characterized by a cleaning device (30) with at least one cleaning element movable, relative to said surface of said transport mechanism, and at least one application element for applying at least one oil-repelling substance to said transport mechanism.

10. The apparatus according to claim 9, characterized by said cleaning device (30) including an application element for applying said at least one oil-repelling substance.

* * * * *